US005876784A

United States Patent [19]

Hesselmann

[11] Patent Number: 5,876,784

[45] Date of Patent: Mar. 2, 1999

[54] TREATMENT DEVICE, PARTICULARLY FOR A TRANSVERSE SIZING MACHINE

[75] Inventor: Theo Hesselmann, Vogtareuth, Germany

[73] Assignee: Planatol Klebetechnik GmbH, Rohrdorf, Germany

[21] Appl. No.: 903,075

[22] PCT Filed: Feb. 15, 1996

[86] PCT No.: PCT/EP96/00648

§ 371 Date: Jul. 30, 1997

§ 102(e) Date: Jul. 30, 1997

[87] PCT Pub. No.: WO96/26148

PCT Pub. Date: Aug. 29, 1990

[30] Foreign Application Priority Data

Feb. 18, 1995 [DE] Germany ..... 295 02 723.1

[51] Int. Cl.[6] ..... B05D 1/00

[52] U.S. Cl. ..... 427/8; 427/289; 427/428; 118/663; 118/674; 118/712; 118/35; 118/37; 118/46; 118/244; 118/259; 101/219; 101/DIG. 46

[58] Field of Search ..... 118/663, 674, 118/712, 35, 37, 46, 244, 259; 427/8, 289, 428; 101/219, DIG. 46

[56] References Cited

U.S. PATENT DOCUMENTS

| | | | |
|---|---|---|---|
| 4,177,730 | 12/1979 | Schriber et al. | 101/219 |
| 4,370,942 | 2/1983 | Dowding et al. | 118/40 |
| 4,541,335 | 9/1985 | Tokuno et al. | 101/219 |
| 4,887,530 | 12/1989 | Sainio | 101/486 |
| 5,184,551 | 2/1993 | Wallmann et al. | 101/219 |

FOREIGN PATENT DOCUMENTS

| | | |
|---|---|---|
| 0 096 832 A2 | 12/1983 | European Pat. Off. . |
| 0 209 110 | 1/1987 | European Pat. Off. . |
| 32 26 907 C2 | 1/1984 | Germany . |
| 35 27 660 A1 | 2/1987 | Germany . |
| 41 29 404 C2 | 3/1992 | Germany . |
| 40 31 964 A1 | 4/1992 | Germany . |
| 648 497 | 3/1985 | Switzerland . |

*Primary Examiner*—Laura Edwards
*Attorney, Agent, or Firm*—McGlew and Tuttle

[57] ABSTRACT

The present invention pertains to a treating device 1, especially a rotating transverse gluing mechanism for high-speed, register mark-related paper or film webs 2. The movements of the transverse gluing mechanism 1 are synchronized with the web 2, and the transverse gluing mechanism has an independent synchronous drive 6 with a drive motor 7 and a regulating unit for this purpose. The electronic regulating unit compensates variations in the synchronism of the running web 2.

20 Claims, 2 Drawing Sheets

TREATMENT DEVICE, PARTICULARLY FOR A TRANSVERSE SIZING MACHINE

FIELD OF THE INVENTION

The present invention pertains to a treating device or applicator, especially a rotating transverse gluing mechanism, for high-speed, register mark-related paper or film webs, where pasty or liquid substances are applied to a substantially constantly moving web.

BACKGROUND OF THE INVENTION

Such transverse gluing mechanisms have been known from DE-A 35 27 660, DE-A 41 29 404, EP-A 0 096 832, and EP-A 0 209 110. They are usually attached to high-performance rotary printing presses and are used to apply a transverse glue strip to predetermined points of the high-speed, printed paper web. The transverse glue strip is usually located at a fold line formed later in the folding device. Its length depends on the printed and folded format in the transverse and longitudinal directions and it must therefore be accurate to the register mark. The cylinder of the transverse gluing mechanism is wrapped around by the running paper web at least partially and it rotates at the same circumferential velocity as the plate cylinder of the printing press, which has the same diameter. This requires a high precision of the drive of the transverse gluing mechanism. The prior-art transverse gluing mechanisms have no separate drive, but they are driven by a unit of the printing press, e.g., a cardan shaft. The drive is derived via toothed belts, universal-joint shafts, bevel gear pairs and the like. The circumstance that a printing press is usually retrofitted with a transverse gluing mechanism and that the printing press has no prepared interfaces for this is problematic. In addition, the drive parts must be calculated and manufactured for high accuracy, which entails a considerable design and mounting effort in the case of multistep intermediate drives.

A similar device is shown in U.S. Pat. No. 4,370,942. A running paper web is perforated here by two perforating rollers in some areas. An adhesive layer is applied to the paper web via a downstream glue spreading roller, with the exception of the perforated areas. The perforating and glue spreading rollers are coupled and synchronized via a gear connection.

DE-A 40 31 964 shows a rotary printing device with a printing block basic body, which is driven by a controllable drive as a function of a speed of rotation control function which is different at different angular positions. The drive is connected to a central control, from which the feed of the material web to be printed on is also controlled via other controllable drives. The printing block basic body follows different angle and control functions during one revolution, and it is adapted, with a limitation in time, both to an inking roller and the material feed and has additional variable velocity functions in between.

CC-A-648 497 discloses a gluing device which has a perforated metal cylinder which rotates synchronously with the substrate web and by which drops of glue are continuously applied to the web. The glue is applied without register mark reference. The synchronization between the cylinder and the web is established in a known, not specifically described manner.

SUMMARY AND OBJECTS OF THE INVENTION

The object of the present invention is to show an improved possibility of attachment for a transverse gluing mechanism or another similar treating device.

This object is accomplished by the present invention having an independent synchronous drive for rotating the applicator, and synchronizing the rotation of the applicator with register marks or format operations of the web, by controlling the independent synchronous drive. Positions on the web are sensed by one of the reference marks applied to the moving web, or format operations performed on the moving web, such as printing, cutting or perforating. These sensed positions are with respect to the applicator.

The control of the synchronous drive can be with a control regulating unit, which contains a microprocessor. The sensing of the positions, can either be by a photosensor to optically detect the register marks, or by a shaft encoder on the cylinder performing such operations as the printing, cutting or perforating, etcetera. The rotational position of the applicator, in comparison with the sensed position of the register mark is used to accurately position the treating of the web.

The treating device or applicator according to the present invention, especially the transverse gluing mechanism, has an independent synchronous drive. Only the velocity and the register mark reference, i.e., the desired position of the fold line, bonding line or the like, is picked off in a suitable manner from the high-speed paper or film web and is used to control and possibly regulate the synchronous drive. An expensive mechanical drive derivation may be abandoned.

The treating device or the transverse gluing mechanism can be attached to a printing press or another similar suitable processing unit for paper or film webs more easily and simply, at a lower cost, and with fewer design and space limitations. The economy of the treating device or transverse gluing mechanism is increased on the whole.

The synchronous drive also offers more possibilities in adaptation and variation of the drive. The rigid coupling of the movements of the web and of the treating device or transverse gluing mechanism can be eliminated. Offset values may be entered via the control, so that the glue strip may also be intentionally applied, if desired, before or behind the fold line in order to better meet the needs of the printed product, such as the thickness of the brochure, etc. In addition, it is simpler to bring the cylinder of the transverse gluing mechanism into the parked position during pauses in operation and then to position it again exactly and correctly to the register mark when the operation is resumed. Expensive mechanical auxiliary means, e.g., an electromagnetic M önninghoff coupling, superimposition couplings or a locking disk with a stop lever, are dispensable.

With the synchronous drive according to the present invention, the treating device has fewer mechanically loaded parts and consequently a longer service life. The amount of maintenance needed is reduced. On the other hand, the drive precision and the velocity can be increased.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
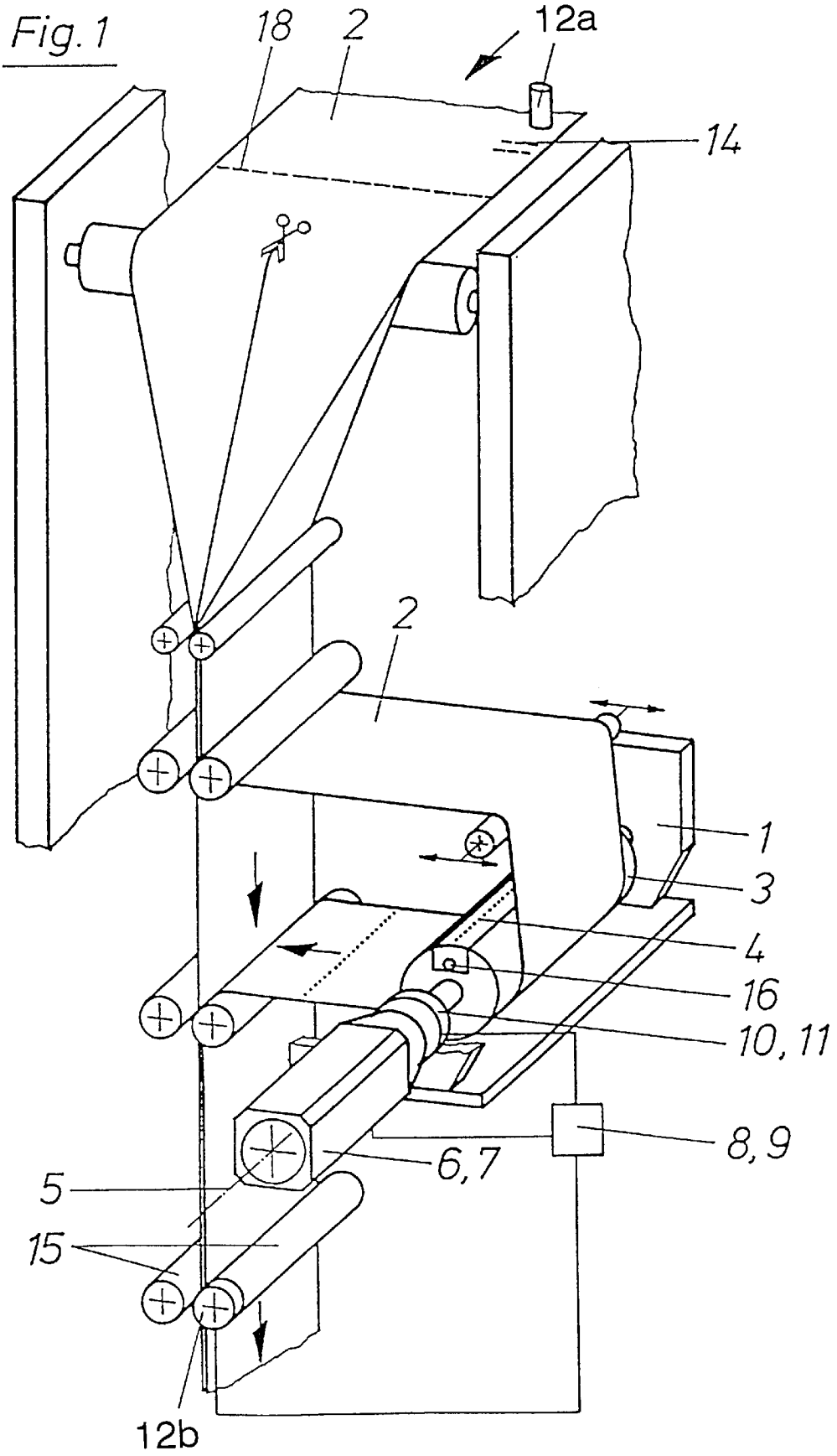
FIG. 1 is a perspective view of a transverse gluing mechanism with a synchronous drive along with parts of the printing press.

FIG. 1 shows a cutaway representation of a treating device 1 for a high-speed, register mark-related paper or film web 2. As an alternative, the web 2 may also consist of cardboard or another, suitable material. This is preferably a printed paper web on a high-performance rotary printing press (not shown).

In a preferred embodiment, the treating device 1 is designed as a transverse gluing mechanism, which has one or more rotating cylinders 3, which is/are tightly wrapped around by the web 2 over at least part of its/their circumference and release(s) at least one glue strip extending at right angles to the direction of movement to the web 2 through a plurality of outlet openings 4 arranged in one or more lines in the jacket. The length and position of the cylinder 3 is coordinated with the width of the web 2. Aside from the drive, the transverse gluing mechanism 1 is designed in any known, suitable manner, e.g., according to EP-A 0 096 832, EP-A 0 209 110, DE-A 35 27 660, or DE-A 41 29 404. There are deflecting and compensator rollers to adjust the wrapping around the web. The cylinder 3 may be a multipart cylinder or a cylinder of variable diameter for adaptation to different printed products.

The transverse gluing mechanism 1 is preferably arranged behind the ink drier and before or at the folder of the rotary printing press. There is only one transverse gluing mechanism 1 with one cylinder 3 in the exemplary embodiment shown. Depending on the type of the print job, there may also be a plurality of transverse gluing mechanisms 1 as well as cylinders 3. The cylinders 3 are adjusted and positioned to the width of the web.

The treating device 1 may also have a different design, e.g., it may be designed as a moistening means, etc. It may be any type of rotating or pivoting member which provides the high-speed web 2 with an applied layer or processes same in another manner. There is a register mark reference, i.e., the application or the treatment takes place at defined points in the direction of movement of the web 2, which is predetermined by the printed format, the folded format or other criteria. The following explanations given concerning the transverse gluing mechanism also apply analogously to the other embodiments of the treating device 1.

The transverse gluing mechanism 1 has an independent synchronous drive 6, which rotates the cylinder 3 in adaptation to the high-speed paper or film web 2. The synchronous drive 6 comprises a drive motor 7, e.g., a controllable d.c. motor, especially a brushless servomotor, and a suitable control circuit 8. The control 8 preferably also contains a regulating unit 9, but it does not do so necessarily in all cases of application.

To synchronize the movements of the web 2 and the cylinder 3, the velocity of the web and the register mark reference are scanned by at least one sensing means such as a suitable, calibrated set point transducer 12*a*, 12*b*, preferably in a contactless manner 12*a*. This may be done in various manners. The set point transducer or transducers 12*a*, 12*b* may be positioned at any desired, suitable point of the printing press. They are preferably located in the vicinity of the transverse gluing mechanism 1. Changes occurring in the web 2 until the transverse gluing mechanism 1 is reached, e.g., due to stretching, etc., may be extensively eliminated or at least detected relatively simply and accurately and may be used to correct the set points.

On the one hand, the web 2 may have register mark-related reference marks 14, which are, e.g., print control strips, color marks or the like. These are in a defined relationship with the printed image or printed format in the direction of movement of the web. The desired position of the transverse glue strip may in turn be determined from the position of the reference marks 14. The reference marks 14 may be scanned by a set point transducer 12*a* designed as, e.g., an optical sensor. The velocity of the web 2 may also be calculated from the scanning pulses obtained and the time interval between them.

In another embodiment, the set point transducer 12*a*, 12*b* may be designed as, e.g., a shaft encoder 12*b*, which is arranged at a suitable axis of rotation that is in connection with a format operaton on the paper web and is related to the register mark. This axis of rotation may be, on the one hand, the plate cylinder itself. A register mark-related cutting roller or perforating roller 15 located close by can usually be reached more easily and simply. The shaft encoder 12*b* is preferably at least cyclically absolute, i.e., it displays each rotation position as an absolute value during a revolution of the axis. There is a calibration for the register mark reference. The number of revolutions may be determined from the passages through the zero point. Such a shaft encoder 12*b* has, e.g., one or more incremental measuring disks, which rotate together with the axis and are scanned in a suitable manner, e.g., by a photoelectric cell, etc.

There may be one or more set point transducers 12*a*, 12*b*, all of which are connected to the control circuit 8 or regulating unit 9 in terms of signal engineering via suitable evaluating and converting units. One or more actual value transducers (10, 11) are also connected to the control circuit 8 or the regulating unit 9.

Figure 2:
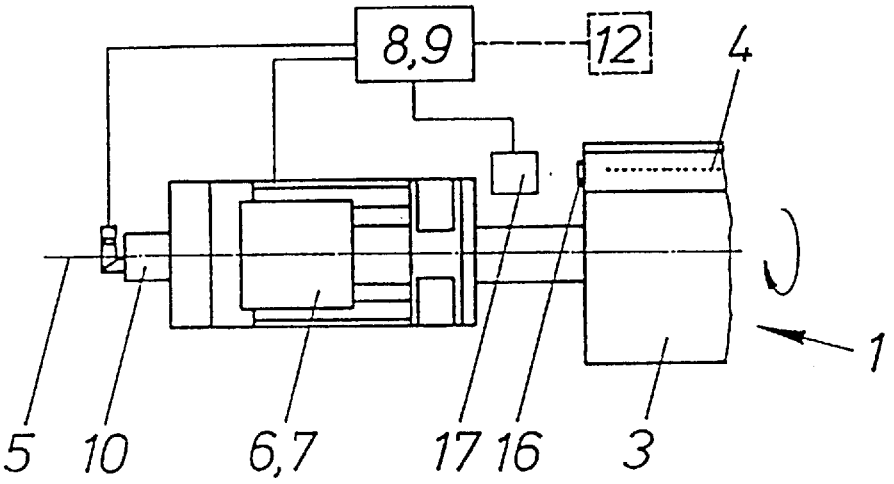
FIGS. 2 and 3 are side views of variants of the synchronous drive.
Figure 3:
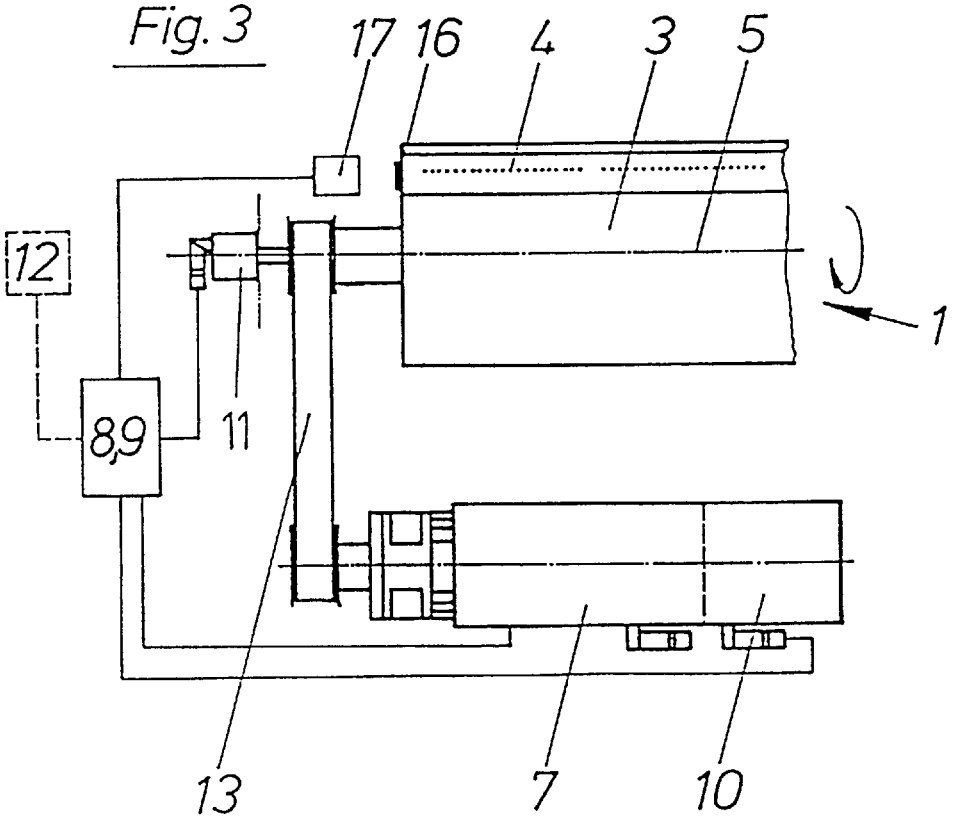

As is illustrated in FIGS. 2 and 3, the number and the arrangement of the actual value transducers (10, 11) may be selected depending on the arrangement of the drive. Cyclically absolute shaft encoders analogous to the above-described embodiment of the set point transducer 12 are preferably used in both cases. In the exemplary embodiment shown in FIG. 2, the drive motor 7 is mounted directly on the axis 5 of the cylinder 3. One actual value transducer 10, which is integrated in the drive motor 7, is sufficient in this case. In FIG. 3, the drive motor 7 is arranged offset next to the cylinder 3 and is connected to same via an intermediate drive 13, e.g., a toothed belt drive, because of space limitations. The arrangement of an actual value transducer 10 in the drive motor 7 and of a second actual value transducer 11 at the axis 5 of the cylinder 3 is recommended in this case. The clearance, tolerances and other transmission errors of the intermediate drive 13 may thus be eliminated.

The actual value transducers (10, 11) are calibrated for the cylinder 3 or the drive motor 7. The calibration against the cylinder 3 also concerns the position of the outlet openings 4 on the cylinder jacket. The actual value transducers (10, 11) thus signal the circumferential velocity and the angular position of the outlet openings 4.

The synchronism between the movement of the web 2 and the rotation of the cylinder 3 is established in the control circuit 8 and the drive motor 7 is energized correspondingly. An adaptation to changes in the velocity of the web during the operation, e.g., during the start-up phase and the phase of deceleration, is also performed. A register mark-free or format-free carrying or acceleration of the cylinder 3 may take place in a selectable, lower speed range of up to, e.g., 15,000 rpm. The exact synchronization accurate to the register mark and format is established after this speed threshold is exceeded. The amount of waste paper generated is reduced by the exact synchronization beginning from a speed of rotation of the printing press which can be used early.

An index 16, which marks the position of the outlet openings 4 and is preferably arranged for this purpose directly at the opening strip, may be additionally arranged at the cylinder 3. The index 16 may be scanned by a suitable sensor 17, e.g., a photoelectric cell, an inductive or capacitive scanner, preferably in a contactless manner. The sensor 17 is in turn connected to the control circuit 8 or the regulating unit 9 and it additionally signals the rotation position of the cylinder 3 or the passage of the index. A plurality of sensors 17 may be arranged, and the sensor or sensors 17 may also be aligned with certain significant rotation positions of the cylinder 3. This may be, on the one hand, the parked position, in which a suitable closure (not shown) covers the outlet openings 4. On the other hand, a sensor 17 may also be arranged at a significant point in the overlapped area between outlet openings 4 and the web 2, i.e., in an area in which the glue is applied.

The control circuit 8 preferably contains a regulating unit 9, which permanently performs a comparison of the set points picked off from the movement of the web and the actual values of the movement of the cylinder and motor. Variances are detected in terms of value and duration and are stored at least temporarily. In the case of variances, the regulating unit performs a countercompensation in order to compensate not only the velocity, but also the accuracy of the register mark. Variances usually also mean a drift of the transverse gluing position in relation to the desired position at the folding line. Depending on the direction of the actual value, the cylinder is briefly driven at a higher or lower speed of rotation within the framework of the countercompensation in order to countercompensate the deviation and to return the position drift of the transverse gluing mechanism.

The control circuit 8 and the regulating unit 9 are designed as electronic, preferably computerized and freely programmable circuits. They contain one or more microprocessors, besides data storage devices, interfaces and input/output units. It is also possible to enter, e.g., fixed or velocity-dependent offset or switch-on values in the control circuit 8 or the regulating unit 9. As a result, it is possible to take into account varying stretchings of the web 2, temperature variations and other boundary conditions in the control or the regulation of the synchronous drive 6.

The glue strip and the register mark reference, especially the fold line, normally coincide. However, the relative position of the glue strip and the register mark reference may be intentionally changed by briefly accelerating or decelerating the synchronous drive 6 in relation to the running web or by rotation at standstill. This makes possible an intended gluing next to the fold line.

The control circuit 8 and the regulating unit 9 may be coupled with the press control of the transverse gluing mechanism 1, be integrated with it integrally or in the manner of a module or be designed as an independent unit.

Various variants of the exemplary embodiment described are possible. A separate synchronous drive 6 of the above-described type may be associated with each unit in the case of a multiple arrangement of transverse gluing mechanisms 1 and cylinders 3. As an alternative, it is also possible to drive a plurality of especially closely spaced cylinders by a common synchronous drive. It is also possible to use separate drive motors with actual value transducers 11 for the different transverse gluing mechanisms in conjunction with a common control circuit 8 or regulating unit 9. Depending on the path of the web and the ambient conditions, a plurality of synchronous drives 6 may also access one or more common set point transducers 12.

In another variant of the exemplary embodiments, the set point and actual value transducers (10, 11, 12) may comprise a plurality of units, which detect the velocity and the position of the register mark separately. The velocities may be picked off, e.g., via a tachometer generator at an axis of rotation, while the rotation position is signaled in another manner, e.g., by indexes or the like.

While specific embodiments of the invention have been shown and described in detail to illustrate the application of the principles of the invention, it will be understood that the invention may be embodied otherwise without departing from such principles.

I claim:

1. A process for treating a moving web, the process comprising the steps of:

printing on the web;

providing an applicator in a form of a rotating cylinder in contact with the web and downstream of said printing, said cylinder having applicator means for applying a liquid substance to a portion of the web;

providing an independent synchronous drive for rotating said cylinder independently of movement of the web;

performing format operations on the web downstream of said applicator;

synchronizing said applicator with a velocity of the moving web by controlling said independent drive of said applicator, said synchronizing including sensing a velocity of the moving web by one of reference marks applied to the moving web and detecting a status of said format operations performed on the moving web.

2. A process in accordance with claim 1, further comprising:

scanning one of said velocity of the web, a position of said reference marks, and said format operations in a contactless manner.

3. A process in accordance with claim 1, wherein:

said synchronization is regulated electronically.

4. A process in accordance with claim 1, wherein:

said synchronization is switched on or off according to selectable criteria, said selectable criteria including one of a speed of rotation of said cylinder and a web velocity reached.

5. A process in accordance with claim 1, further comprising:

compensating said synchronizing for external effects, including one of temperature variations of said applicator and the web, and for stretching of the web by varying rotation of said cylinder.

6. A process in accordance with claim 1, wherein:

said synchronization includes changing said register marks or format operations by decelerating or accelerating said applicator in relation to the velocity of the web.

7. An apparatus for treating a moving web discharged from a printing press, the apparatus comprising:

a rotating cylinder, said cylinder having applicator means for applying a liquid substance to a portion of the web downstream from the printing press;

format means for performing format operations on the web downstream from said applicator means;

sensing means for sensing a position of the web by one of a reference mark on the web and a status of one of the printing press and said format means;

independent synchronous drive means for synchronizing said applicator means with said position of the moving web as sensed by said sensing means, said independent synchronous drive means including controlling rotation of said cylinder independently of movement of the web, operation of the printing press and operation of the format means.

8. An apparatus in accordance with claim 7, wherein:

said synchronous drive means has a drive motor and a regulating unit for synchronization of movements of said applicator means and of said web to said register marks or said format operation means.

9. An apparatus in accordance with claim 8, wherein:

said regulating unit has a programmable electronic circuit.

10. An apparatus in accordance with claim 8, wherein:

said regulating unit countercompensates variations in synchronism.

11. An apparatus in accordance with claim 7, wherein:

said sensing means has at least one set point transducer means for detecting at least one of a velocity of the web, and a position of said register mark.

12. An apparatus in accordance with claim 8, wherein:

said synchronous drive means has at least one actual value transducer means for detecting a speed of rotation of said drive motor.

13. An apparatus in accordance with claim 8, wherein:

said synchronous drive means has at least one set point transducer means for detecting at least one of a velocity of the web, and a position of said register mark;

said synchronous drive means has at least one actual value transducer means for detecting a speed of rotation of said drive motor;

one of said set point transducer and said actual value transducer is a cyclically absolute shaft encoder.

14. An apparatus in accordance with claim 13, wherein:

said set point transducer is arranged at said register mark or at said format means;

said format means including one of a related cutting means, bonding means, folding means and a perforating roller.

15. An apparatus in accordance with claim 13, wherein:

said set point transducer is a scanning means for scanning said reference marks on the web.

16. An apparatus in accordance with claim 14, wherein:

said synchronous drive means has an index at one of said cylinder and at said one of said cutting means or said perforating roller for identifying a position of outlet openings of said applicator means, said synchronous drive means has an additional scanning means for scanning said index.

17. A process for treating a moving web, the process comprising the steps of:

printing on said web;

applying a strip of liquid across the web in a direction transversely to a moving direction of the web, said applying including rotating a cylinder in contact with the web, said cylinder having applicator means for applying said liquid to the web;

performing format operations on the web downstream of said applying of said strip of liquid;

providing an independent synchronous drive for rotating said cylinder independently of movement of the web, independently of said printing and independently of said format operations;

synchronizing said applying of said strip of liquid with positions on the moving web by controlling said independent drive of said cylinder, said synchronizing including detecting said positions on the web by one of sensing reference marks on the web and measuring a status of one of said printing and said format operations.

18. A process in accordance with claim 17, wherein:

said format operations include one of folding, cutting, bonding and perforating the web.

19. A process in accordance with claim 17, wherein:

said measuring of said status of said printing and format operations is by shaft encoder means for measuring rotational positions of structure performing said printing and said format operations.

20. A process in accordance with claim 17, wherein:

said printing creates a repetitive pattern on the web;

said applying of said strip of liquid is performed repetitively on the web;

said liquid is an adhesive.

* * * * *